US005971638A

United States Patent [19]

Sato et al.

[11] Patent Number: 5,971,638

[45] Date of Patent: Oct. 26, 1999

[54] PRINTER SHEET FEED MECHANISM INCLUDING FEED ROLLER HAVING PLURALITY OF PROJECTIONS

[75] Inventors: Hiroshi Sato; Takanobu Matsuura, both of Iwate-ken, Japan

[73] Assignee: Alps Electric Co., Ltd., Tokyo, Japan

[21] Appl. No.: 09/016,719

[22] Filed: Jan. 30, 1998

[30] Foreign Application Priority Data

Jan. 31, 1997 [JP] Japan ..... 9-018784
Feb. 26, 1997 [JP] Japan ..... 9-058402

[51] Int. Cl.[6] ..... B41J 13/076; B65H 27/00

[52] U.S. Cl. ..... 400/578; 226/193; 226/191; 492/31; 492/36; 400/636

[58] Field of Search ..... 400/578, 634, 400/636; 226/193, 191; 492/28, 30, 31, 33, 34, 35, 36, 37

[56] References Cited

U.S. PATENT DOCUMENTS 5,138,341 8/1992 Kobayashi ..... 226/193
5,553,806 9/1996 Lucas ..... 492/33
5,645,361 7/1997 Mitsushima et al. ..... 400/634

FOREIGN PATENT DOCUMENTS 0 832 835 A2 4/1998 European Pat. Off. .
60-023248 2/1985 Japan .
60-258050 12/1985 Japan .
07277555 10/1995 Japan .
08086309 4/1996 Japan .

*Primary Examiner*—Edgar Burr
*Assistant Examiner*—Leslie J. Grohusky
*Attorney, Agent, or Firm*—Brinks Hofer Gilson & Lione

[57] ABSTRACT

In a printer sheet feed mechanism for feeding a sheet such as a paper sheet, an OHP sheet and the like with a pinpoint accuracy, maintaining a sheet feed accuracy to a high level for a long time and improving recording quality, a sheet feed roller is composed of a metal shaft having a plurality of projections formed on the surface thereof and pressure rollers to be abutted against the surface of the sheet feed roller have hardness and a pressure contact force to the sheet feed roller which are selected suitably. The surface of each of pressure roller shafts formed rotatably integrally with the pressure roller is subjected to surface processing having a lubricating property.

3 Claims, 5 Drawing Sheets

PRINTER SHEET FEED MECHANISM INCLUDING FEED ROLLER HAVING PLURALITY OF PROJECTIONS

BACKGROUND OF THE INVENTION (1) Field of the Invention

The present invention relates to a sheet feed mechanism used to printers and the like and preferable to clamp a sheet by pressing pressure rollers against a sheet feed roller and feed the sheet to a recording section by the rotation of the sheet feed roller.

(2) Description of the Prior Art

In general, serial ink jet printers or thermal transfer printers execute predetermined recording by repeating such operation that a line of data is recorded while moving a carriage on which a recording head is mounted along a platen and thereafter a recording sheet is fed one line for the recording of a next line. A large number of this type of the printers are used as an output device for computers, word processors and the like because they can execute high quality recording in a low-noise environment at a low cost and their maintenance is easy.

FIG. 8 shows a thermal transfer printer as an example of the conventional serial printers. The printer includes a flat-plate-shaped platen 2 disposed at the center of the frame 1 thereof so that the recording surface thereof is located at approximately right angle. A carriage shaft 3 is disposed in parallel with the platen 2 below the platen 2 of the frame 1 in front of it. A flange-shaped guide section 4 is formed to the front edge of the frame 1 and a carriage 5 is mounted on the carriage shaft 3 and the guide section 4 so as to reciprocate along them. A thermal head 6 is mounted on the carriage 5 at the extreme end thereof in confrontation with the platen 2 so that it is caused to come into contact with and be separated from the platen 2 by a not shown drive mechanism. Detachably mounted on the upper surface of the carriage 5 is a ribbon cassette (not shown) which accommodates an ink ribbon in it and guides the ink ribbon between the thermal head 6 and the platen 2.

Further, a winding bobbin 7 for winding the ink ribbon of the ribbon cassette and a feed bobbin 8 on a feed-out side are disposed on the upper surface of the carriage 5, respectively.

A sheet inserting port 9 for inserting a recording sheet (not shown) is formed rearwardly of the platen 2 and further a sheet feed roller 10 for feeding the sheet inserted from the sheet inserting port 9 to the front side (recording section) of the platen 2 is rotatably supported by bearings rearwardly of the platen 2. A plurality of pressure rollers 11 are disposed under the sheet feed roller 10 in parallel therewith so as to come into contact with the surface of the sheet feed roller 10. Each of the pressure rollers 11 has a pressure roller shaft 11*a* formed thereto so that it is rotatable integrally with the pressure roller 11. Further, the pressure roller shafts 11*a* are rotatably supported directly by pressure roller holders 11*b* without using bearings.

On the other hand, a sheet feed gear 12 mounted coaxially with the sheet feed roller 10 projects from a side of the frame 1. The sheet feed gear 12 is connected to the motor gear 15 of a sheet feed motor 14 through a plurality of transmission gears 13, 13. The rotation of the sheet feed motor 14 permits the sheet feed roller 10 to be rotated through the motor gear 15, the respective transmission gears 13 and the sheet feed gear 12 so that the sheet inserted between the sheet feed roller 10 and the pressure rollers 11 from the sheet inserting port 9 is fed while being clamped therebetween.

In the thermal-transfer printer arranged as described above, the sheet is inserted from the sheet inserting port 9, clamped between the sheet feed roller 10 and the pressure rollers 11 and fed to a recording start position in the direction perpendicular to the moving direction of the carriage 5 by the rotation of the sheet feed roller 10 effected by the sheet feed motor 14. Then, desired recording is carried out to the sheet by the partial transfer of ink as a coloring agent to the sheet by selectively energizing the recording elements of the thermal head 6 based on image information while moving the carriage 5 along the platen 2 in the state that the thermal head 6 is pressed against the platen 2 through the ink ribbon and the sheet. Thereafter, each time recording of one line is finished, the sheet is fed for next recording.

Since the above heat-transfer printer is arranged such that each time recording of one line is finished, next recording is executed by feeding the sheet, a pinpoint sheet feed accuracy is required. When a sheet feed accuracy is low and a feed amount of sheet is larger than a predetermined amount, an unrecorded portion or a so-called white stripe is made between lines, whereas when a feed amount of sheet is smaller than the predetermined amount, a double-recorded portion or a so-called black stripe is made to the overlapped portion between lines, and any of the stripes greatly lowers the quality of a recorded image.

Note, sheets used to print include a paper sheet, an OHP sheet composed a transparent resin sheet and the like and they are called a recording sheet or simply a sheet as a whole.

Incidentally, in the conventional sheet feed mechanism, the sheet feed roller 10 is composed of a cylindrical metal core and a rubber roller main body attached, each of the pressure rollers 11 is composed a cylindrical metal core and a rubber roller main body attached to the outer circumference thereof likewise the sheet feed roller 10 and the sheet feed mechanism is composed of the pressure rollers 11 pressed against the sheet feed roller 10.

When each of the sheet feed roller 10 and the pressure rollers 11 is composed of the rubber roller main body attached around the outer circumference of the cylindrical metal core as arranged conventionally, there is a problem that when they are pressed against each other, since the respective roller main bodies of the sheet feed roller 10 and the pressure rollers 11 are elastically deformed and the radii of the respective rollers 10, 11 are changed, a sheet such as an OHP sheet, a paper sheet and the like cannot be fed in an accurate feed amount.

Further, there may be caused a case that the roller main bodies of the sheet feed roller 10 and the pressure rollers 11 are not uniformly deformed in the axial direction thereof and a sheet is obliquely fed.

Further, since the surfaces of both the rollers 10, 11 are formed of rubber, a grip force for clamping a sheet is reduced, by which the sheet is slipped. Thus, the accurate feed amount of the sheet cannot be also obtained in this respect.

Therefore, in the sheet feed roller 10 and the pressure rollers 11 arranged as described above, there is a problem that a white stripe or a black stripe is made between the recorded lines on a sheet, and when overlapped recording such as color recording is carried out, there is caused a problem that recorded positions are dislocated and a recorded image of good quality cannot be obtained.

When the conventional thermal transfer printer can execute heat sublimation print, each of the pressure rollers 11 of the sheet feed mechanism is formed of an elastic resin which does not contain a thermoplastic material because there is a possibility that they are heated to a high temperature. Further, each of the pressure roller shafts 11*a* is composed of a metal shaft the surface of which is subjected to Ni plating process. Although the pressure roller holders apply pressure contact force to the pressure rollers 11 by urging springs (not shown) disposed therein, the holders are formed of plastics containing highly strong glass fibers to prevent their creep deformation caused by the spring force of the urging springs.

However, the conventional printer sheet feed mechanisms have a problem that when the pressure roller shafts 11*a* are repeatedly rotated by being directly supported by the pressure roller holders in accordance with the rotation of the pressure rollers 11, the Ni-plated surfaces of the pressure roller shafts 11*a* are scratched by the glass fibers contained in the pressure roller holders 11*b*, whereby sliding resistance between the roller shafts and the roller holders is increased and the feed amount of sheet is reduced. For example, the feed amount of an ordinary sheet and a sublimation sheet is reduced by about 0.6–0.8 mm and that of an OHP sheet is reduced by about 1.0–1.4 mm when they are fed 240 mm. Since the reduction of the feed amount On the other hand, sheet eminently appears as a black line when recording is executed by a color printer, improvement is required.

SUMMARY OF THE INVENTION

A printer sheet feed mechanism according to the present invention has a feature that it comprises a sheet feed roller composed of a metal shaft having a circular cross section and a plurality of projections formed around the outer circumferential surface thereof by partially projecting the metal shaft itself and pressure rollers pressed against the sheet feed roller and the Shore hardness (A) of the pressure rollers is set to 70–97 degrees.

Further, the printer sheet feed mechanism has a feature that the pressure rollers pressed against the sheet feed roller have a pressure contact force in the range from 40 to 150 gf per one piece of the projections.

An object of the invention is to provide a printer sheet feed mechanism capable of feeding a print sheet with a pinpoint accuracy without causing a flaw and skew to it by the employment of the above arrangement.

A printer sheet feed mechanism according to the present invention has a feature that surface processing having a lubricating property is applied to the surfaces of the pressure roller shafts.

An object of the invention is to maintain a sheet feed accuracy to a high level for a long time and improve recording accuracy.

A printer sheet feed mechanism according to the present invention has a feature that the surface processing applied to the pressure roller shafts is applied to at least the portions of the surfaces of the pressure roller shafts which are in contact with the pressure roller holders.

An object of the invention is to maintain the sheet feed accuracy to a high level for a long time and improve recording accuracy by surface processing the minimum areas of the surfaces of the pressure roller shafts by the employment of the above arrangement.

Further, a printer sheet feed mechanism according to the present invention has a feature that a fluorine containing nickel plating process, a molybdenum compound coating process or a fluorine compound coating process is applied as the surface processing of the pressure roller shafts.

An object of the invention is to more securely improve the lubricating property and durability of the pressure roller shafts and maintain the sheet feed accuracy for a long time by the employment of the above arrangement.

DETAILED DESCRIPTION OF THE PREFERRED EMBODIMENTS

Figure 1:
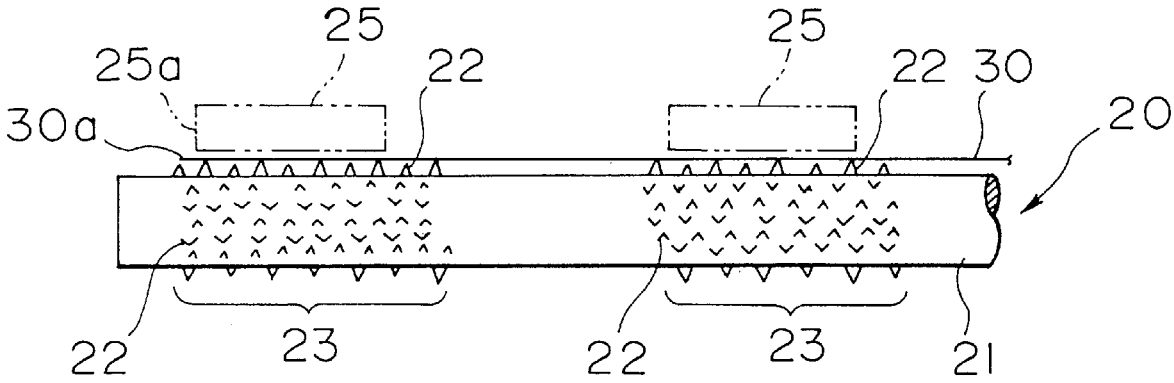
FIG. 1 is a view describing a printer sheet feed mechanism of the present invention.
Figure 2:
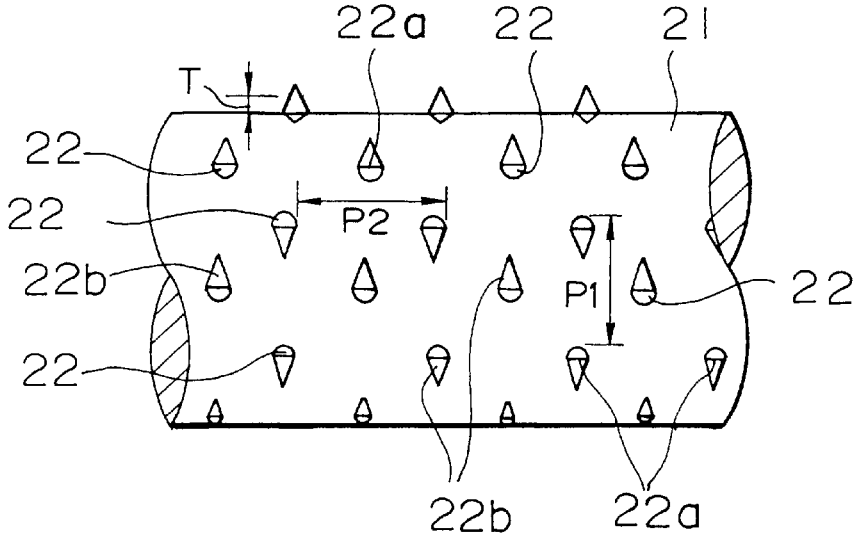
FIG. 2 is an enlarged view of the main portion of a sheet feed roller according to the sheet feed mechanism of the present invention.

Embodiments of the present invention will be described below with reference to the drawings. FIG. 1 is a view describing a printer sheet feed mechanism of the present invention and FIG. 2 is an enlarged view of the main portion of a sheet feed roller according to the sheet feed mechanism of the present invention. The printer sheet feed mechanism of the present invention will be described with reference to the drawings.

A sheet feed roller 20 is composed of a cylindrical metal shaft 21 having a circular cross section and a plurality of projections 22 formed around the outer circumferential surface thereof by partially projecting the metal shaft 21 itself.

Then, the plurality of projections 22 are formed in the axial direction and the circumferential direction of the metal shaft 21 at predetermined intervals in a staggered-shape as well as a plurality of regions 23 composed of a plurality of groups of the projections 22 are formed in the axial direction at intervals.

As shown in FIG. 2, each of the projections 22 is formed to a half-dome-shape composed of a vertical plane 22*a* facing a roller rotating direction and a quarter-spherical surface continuous to the vertical plane and has a height T of 30–90 $\mu$m, a circumferential pitch P1 of 0.2–0.6 mm and an axial pitch P2 of 0.6–1.8 mm.

The vertical planes 22*a* of the respective half-dome-shaped projections 22 face the rotational direction of the sheet feed roller 20 respectively and the plurality of the projections 22 in the same row in the axial direction of the sheet feed roller 20 face the same direction.

The vertical plane 22*a* of the respective projections 22 in two adjacent rows face a reverse direction, respectively as well as the projections 22 in a plurality of rows are arranged in the staggered state as described above.

Each of pressure rollers 25 disposed so as to be pressed against the sheet feed roller 20 is formed to a cylindrical shape with a circular cross section and composed of a rubber material having Shore hardness (A) of 70–97 degrees.

The pressure rollers 25 are disposed to the respective regions 23 composed of the groups of the projections 22 and have a width a little narrower than the width of the regions to permit the entire outer circumferential surfaces thereof to uniformly come into contact with the projections 22 of the sheet feed roller 20 under pressure. Moreover, the pressure contact force of the pressure rollers 25 pressed against the sheet feed roller 20 under pressure is set to 40–150 gf per one piece of the projections 22 and the sheet feed mechanism is composed of the sheet feed roller 20 and the pressure rollers 25 to feed a sheet 30 such as an OHP sheet, a paper sheet or the like by clamping it therebetween.

Figure 3:
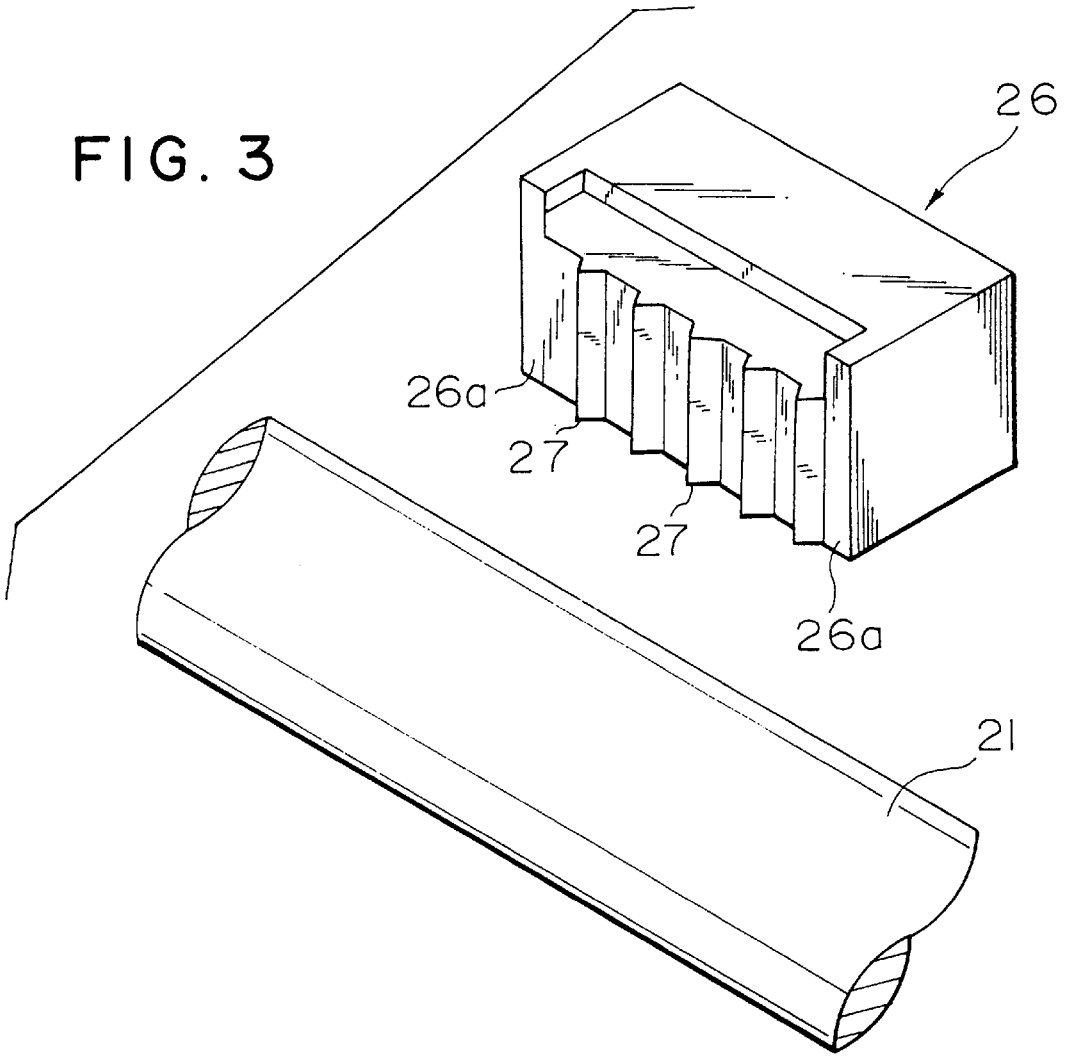
FIG. 3 is a view describing how the sheet feed roller according to the sheet feed mechanism of the present invention is manufactured.

Next, FIG. 3 is a view describing how the sheet feed roller according to the printer sheet feed mechanism of the present invention is manufactured. A manufacturing method of the sheet feed roller 20 in the present invention will be described base on the drawing. As shown in FIG. 3, a punch 26 has stoppers 26*a* formed to both the ends thereof so that a dimensional accuracy can be obtained by causing the stoppers 26*a* to be abutted against the outer circumference of the metal shaft 21 after it is stamped.

When the teeth 27 of the punch 26 are abutted against metal shaft 21, the surface of the metal shaft 21 is cut and raised and a slipper-shaped processed section composed of a cut-off recess 22*b* and the projection 22 which serves as the aforesaid half-dome-shaped projection.

Note, the metal shaft 21 may be formed a solid cylindrical shape or a hollow cylindrical shape so long as it has a circular outer circumferential surface.

As shown in the drawing, the punch 26 has teeth 27 formed to a single row at predetermined intervals. The teeth 27 have a predetermined height to cut the metal shaft 21 to a predetermined depth and form the single row of the projections 22 by stamping executed once. However, since two sets of the punches 26 are disposed across the metal shaft 21 in confrontation with each other with the teeth 27 thereof facing a reverse direction and further the positions of the teeth 27 of the two punches 26 are dislocated in the axial direction of the metal shaft 21, the projections 22 of two rows are simultaneously stamped (not shown).

On the completion of the stamping for one line, the metal shaft 21 is turned a predetermined angle for the stamping of next rows.

The predetermined angle of turn of the metal shaft 21 is set to permit the projections 22 to be formed reversely by other punches 26 between the stamped projections 22.

When the stamping is executed for the one turning area of the metal shaft 21, the thus formed projections 22 have the vertical planes 22*a* which face a reverse direction in the respective rows as well as are disposed in the staggered shape for the respective rows.

When the metal shaft 21 is stamped for the one turning area thereof, it is moved a predetermined distance in the axial direction and the projections 22 are formed to the portion of the metal shaft 21 which confront the next pressure roller 25.

The sheet feed roller 20 having the desired projections 22 formed thereto is obtained by the repetition of the above operation.

Figure 4:
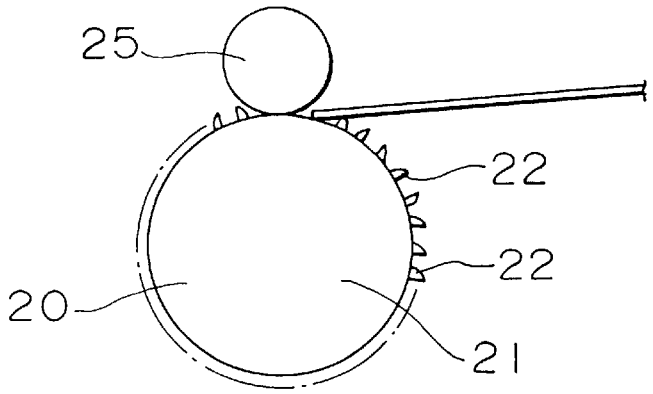
FIG. 4 is a view describing the bite of a sheet between the sheet feed roller and a pressure roller according to the sheet feed mechanism of the present invention.

FIG. 4 is a view describing the bite of a sheet between the sheet feed roller and the pressure roller according to the printer sheet feed mechanism of the present invention. As shown in the drawing, the sheet 30 is fed by the frictional force of the projections 22 of the sheet feed roller 20 until the extreme end 30*a* of the sheet 30 is clamped between the sheet feed roller 20 and the pressure rollers 25.

After the sheet 30 is clamped between the sheet feed roller 20 and the pressure rollers 25, a feed force is obtained by the bite of the extreme ends of the projections 22 of the sheet feed roller 20 into the sheet 30.

The provision of the projections 22 with the metal shaft 21 eliminates the elastic deformation of the sheet feed roller 20 and permits an accurate feed amount of the sheet 30 to be obtained.

According to an experiment, although a grip force is obtained by causing the projections 22 to bite into the sheet 30, it has been found that an amount of bite has an important role to the stable feed of the sheet. As a result of the experiment, a proper amount of bite can be obtained by setting the pressure contact force for one piece of the projection to 40–150 gf and the Shore hardness (A) of the pressure rollers 25 to 70–97 degrees, by which the sheet 30 can be fed in an accurate feed amount through a grip force which does not cause any flaw to the sheet 30 with a very small amount of skew thereof.

That is, when the pressure contact force made by the pressure rollers 25 is lower than 40 gf/piece, it is skewed because the projections 22 do not bite into the sheet 30, whereas when pressure contact force is higher than 150 gf/piece, flaws are made to the sheet 30 and when the printed sheet is reversely fed to print another color on a printed surface again, an initially printed ink is exfoliated and the quality of print is lowered.

When the hardness of the pressure rollers 25 is lower than 70 degrees, since the portion of the pressure rollers 25 pressed by the projections 22 of the sheet feed roller 20 to cover the projections 22 is flexed, the amount of bite of the projections 22 into the sheet 30 is reduced, a sufficient grip force cannot not obtained and the sheet 30 is skewed, whereas when the hardness is higher than 97 degrees, since the pressure contact force of the pressure rollers 25 to the projections 22 is made excessively high, flaws are made to the sheet 30 and when the printed sheet 30 is reversely fed to print another color on the printed surface, the initially printed ink is exfoliated and the quality of print is lowered.

According to the experiment, it has been found that since the OHP sheet has a surface which is harder than that of the paper sheet, it is difficult for the projections 22 to bite into the OHP sheet. Thus, a grip force and skew when the sheet is fed greatly affect the circumferential pitch P1 and the axial pitch P2 of the projections 22.

That is, as a result of the experiment, when the circumferential pitch P1 of the projections 22 was set to 0.2–0.6 mm and the axial pitch P2 thereof was set to 0.6–1.8 mm, the skew was greatly reduced and the OHP sheet could be fed by a proper grip force.

When both the pitches P1, P2 depart from the above values and are made narrower than them, since a load imposed on one piece of the projections 22 is dispersed and reduced, a sufficient amount of bite is not obtained. When the axial pitch P2 is wider, the number of the projections 22 bitten into the sheet is made insufficient and the grip force is made insufficient accordingly and further when the circumferential pitch P1 is wider, an amount of flexure of the OHP sheet is increased among the projections 22, by which the feed of the sheet is made unstable.

Further, according to the experiment, the height of the projections 22 greatly affects the feed of the sheet. As a result of the experiment, when the height T of the projections 22 is set to 30–90 μm, both the paper sheet and the OHP sheet can be securely fed without causing flaws thereto with a proper amount of bite to the sheet 30 and the initial insertion (cueing) of the sheet between both the rollers 20 and 25 can be securely executed.

When the height T departs from the above range and is made lower than 30 μm, since the sheet 30 comes into contact with not only the projections 22 but also the outer circumferential surface of the sheet feed roller 20, a load is dispersed, a sufficient amount of bite of the projections 22 into the sheet 30 cannot be obtained, whereas when the height T is higher than 90 μm, the extreme end of the sheet 30 is caught by the projections 22, the sheet 30 cannot be fed up to the portion where the sheet feed roller 20 is in contact with the pressure rollers 25, the feed of the sheet 30 fails and cueing cannot be executed as well as when the sheet 30 is forcibly fed, there is caused a disadvantage that flaws are made to the sheet 30 by the projections 22.

As described above, according to the printer sheet feed mechanism of the present invention, since the sheet feed roller is composed of the metal shaft to which the projections are formed, the roller is not elastically deformed and a sheet can be correctly fed by it.

The present invention can provide the sheet feed mechanism capable of obtaining a proper amount of bite to the sheet by setting the Shore hardness (A) of the pressure rollers to 70–97 degrees and an accurate amount of feed which is achieved by a grip force having a very small amount of skew of the sheet without causing any flaw to it.

Further, the present invention can provide the sheet feed mechanism which is very preferable to feed the sheet by setting the Shore hardness (A) of the pressure rollers to 70–97 degrees and the pressure contact force thereof to 40–150 gf per one piece of the projections.

Another embodiment of the printer sheet feed mechanism of the present invention will be described with reference to FIG. 5 to FIG. 7. The same arrangements as those of the aforesaid conventional printer sheet feed mechanism are denoted by the same numerals and they are not described again.

Figure 5:
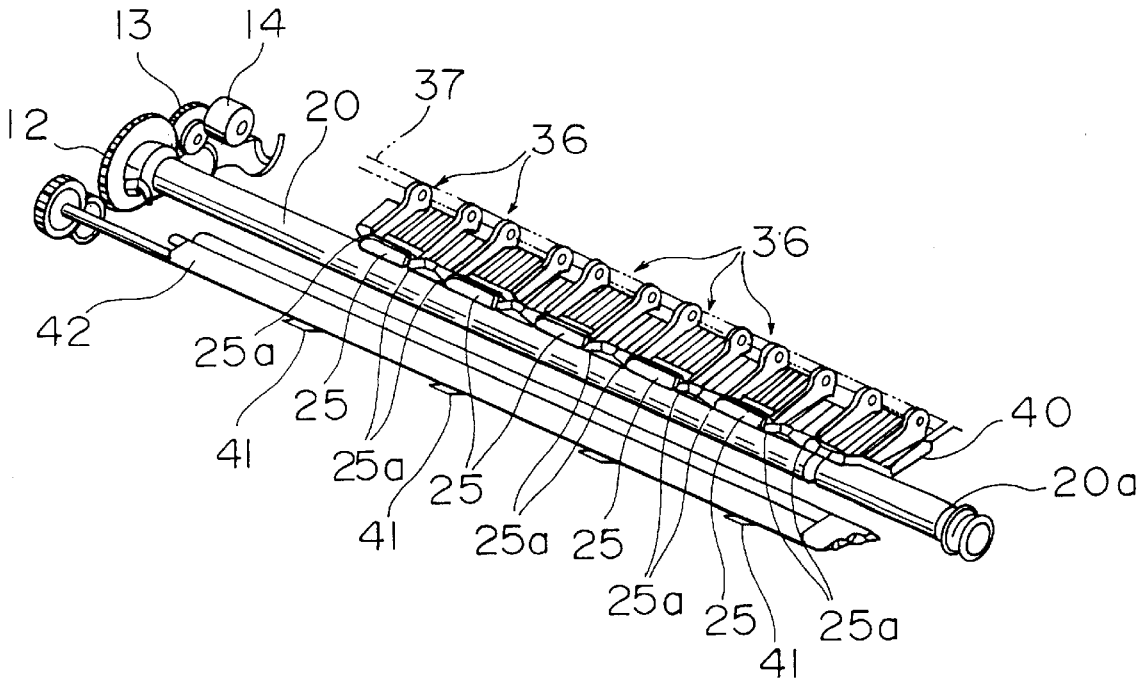
FIG. 5 is a perspective view showing the main portion of another embodiment of the printer sheet feed mechanism of the present invention.

FIG. 5 shows a perspective view of the main portion of the embodiment, wherein pressure rollers 25, 25 . . . come into contact with the surface of a sheet feed roller 20 from the upper side thereof to thereby horizontally feed a sheet. This arrangement is fundamentally the same as that of the conventional printer sheet feed mechanism. However, the embodiment is different from the conventional one in that surface processing having a lubricating property is applied to the surfaces of pressure roller shafts 25*a*, 25*a* . . . which are rotating shafts of the pressure rollers 25, 25 . . .

That is, the cylindrical sheet feed roller 20 composed of a metal shaft is rotatably supported in a horizontal direction by bearings 20*a* and the plurality of pressure rollers 25, 25 . . . are disposed on the sheet feed roller 20 in a longitudinal direction and supported by the pressure roller shaft 25*a*, 25*a* . . . so as to be abutted against the surface of the sheet feed roller 20. These pressure roller shaft 25*a*, 25*a* are formed integrally with the pressure rollers 25, 25 by being inserted thereinto. Each of the pressure roller shafts 25*a*, 25*a* . . . is rotatably supported by the two arm sections 36*a* of pressure roller holders 36, 36 . . . The pressure roller holders 36, 36 . . . are rotatably supported by a holder shaft 37 at the base ends 36*b* thereof, the holder shaft 37 being laterally disposed to a support section 1*a* fixed to a frame 1. A sheet press lever 38 is coupled with the holder shaft 37 to press the pressure rollers 25, 25 . . . against the sheet feed roller 20 and release the pressure rollers 25 pressed against the sheet feed roller 20. Further, an urging lever 39 is disposed to each of the pressure roller holders 36, 36 . . . between the holder and the support section 1*a* to apply an urging force for clamping a sheet on the sheet feed roller 20 side around the holder shaft 37.

Figure 6A:
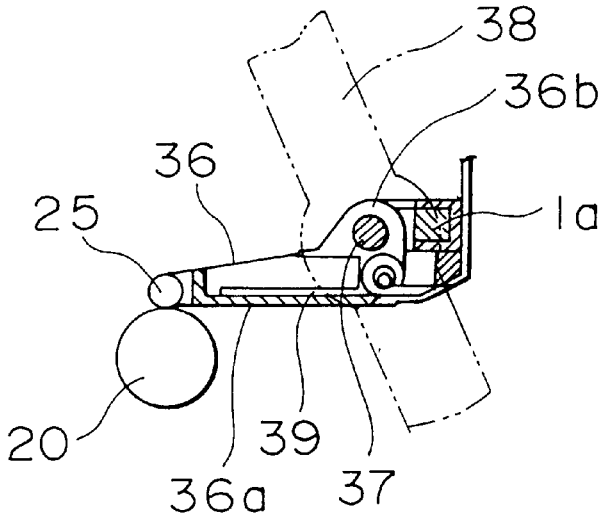
FIG. 6A is a view describing how a pressure roller is pressed against a sheet feed roller in the embodiment and FIG. 6B is a view describing how the pressure roller pressed against the sheet feed roller is released.
Figure 6B:
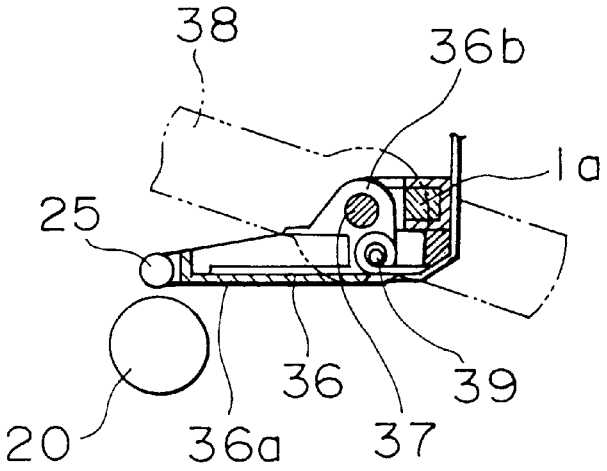
Figure 7:
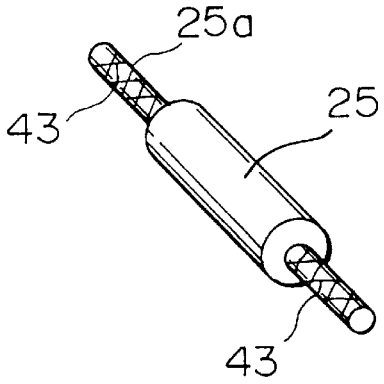
FIG. 7 is a view describing surface processing applied to a pressure roller shaft in the embodiment.
Figure 8:
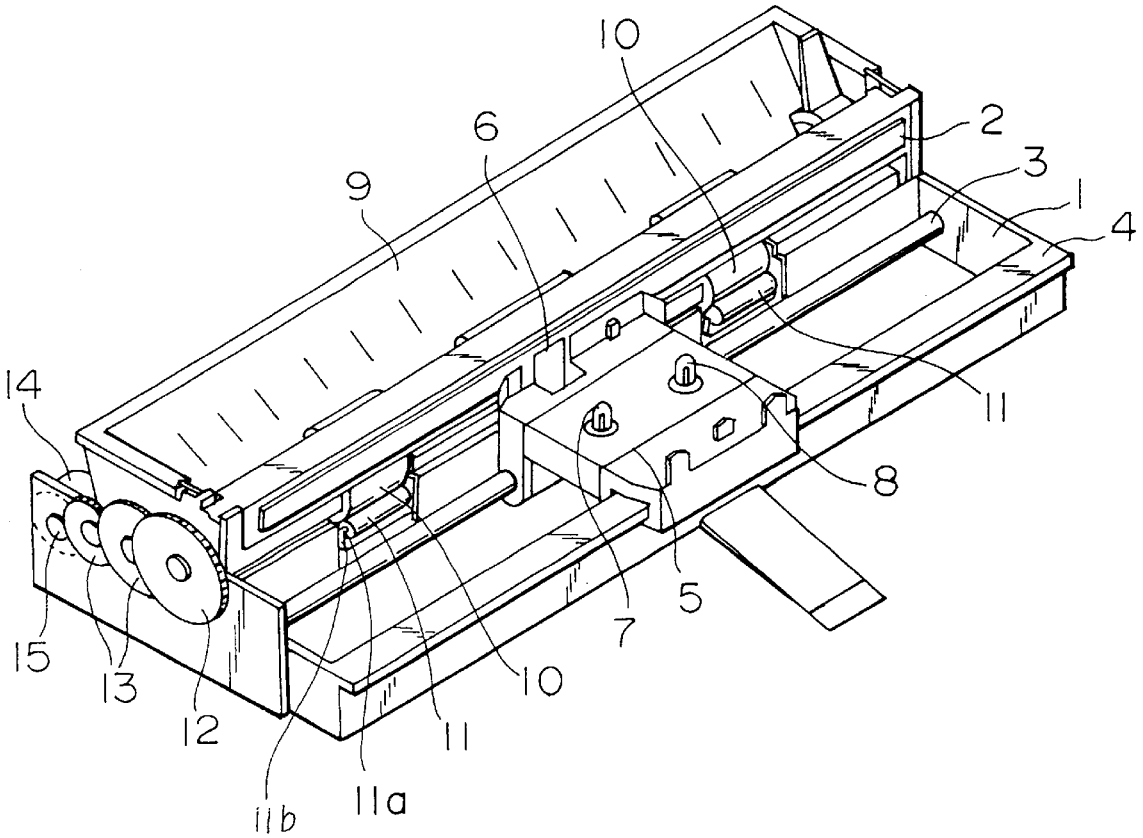
FIG. 8 PRIOR ART
FIG. 8 is a view showing the arrangement of a printer having a conventional printer sheet feed mechanism.

FIG. 6A and FIG. 6B show the operation of the pressure rollers 25, 25 . . . which are pressed against and released from the sheet feed roller 20. FIG. 6A shows the state that the pressure rollers 25, 25 . . . are pressed against the sheet feed roller 20 by the elastic forces of the urging levers 39 which are applied by turning the sheet press levers 38 clockwise and FIG. 6B shows the state that the pressed pressure rollers 25, 25 . . . are released by tuning the sheet press levers 38 counterclockwise against the elastic forces of the urging levers 39.

A sheet detecting roller unit 40 is rotatably mounted on the holder shaft 37 at the extreme end of the pressure roller holders 36, 36 . . . (at a position adjacent to the rightmost pressure roller holder 36 in FIG. 5) to confirm the sheet before and after recording and detect the cueing of the sheet when it is automatically fed.

On the other hand, sheet discharge rollers 41 and a sheet discharge cover 42 are disposed in front of the sheet feed roller and the sheet discharge cover 42 is urged to the sheet discharge rollers 41 by the action of a not shown spring so that sheets recording to which has been finished are clamped and sequentially discharged.

Next, surface processing applied to the surfaces of of the pressure rollers 25, 25 . . . will be described.

Since the pressure rollers 25, 25 . . . are composed of very small parts, there is no space for accommodating bearings between the pressure roller holders 36, 36 . . . and the pressure roller shafts 25*a*, 25*a* . . . Thus, this problem is coped with by applying surface processing having a lubricating property to the pressure roller shafts 25*a*, 25*a* . . . That is, as shown in FIG. 7, the surface processing having the lubricating property is applied to at least the sliding contact portions 43 of the surfaces of the pressure roller shafts 25*a*, 25*a* . . . which are in sliding contact with the pressure roller holders 36, 36 . . . For the selection of the surface processing, the pressure roller shafts 25*a*, 25*a* . . . to which various types of surface processing were applied were prepared and an experiment was carried out to determine how much the reduction of a sheet feed amount could be suppressed when sheets were fed using the respective pressure roller shafts 25*a*, 25*a* . . .

In the experiment, a nickel born plating process, a nitriding process, a hard chromium process, a fluorine containing nickel plating process, a molybdenum compound coating process and a fluorine compound coating process were employed, respectively as objects to be examined, ordinary sheets were used as sheets to be fed and the ordinary sheets were fed 240 mm to measure a feed error by comparing the actual feed amount of the sheets with a predetermined feed amount. Table 1 shows a result of the experiment

TABLE 1

Sheet Feed Amount Error in Various Types of Processing

| Type of Surface Processing | Reduced Value of Sheet Feed Amount (mm) |
|---|---|
| Nickel Born Plating Process | 0.5–0.6 |
| Nitriding Process | 0.55–0.7 |
| Hard Chromium Process | 0.5–0.6 |
| Fluorine Containing Nickel Plating Process | 0.1–0.2 |
| Molybdenum Compound Coating Process | 0.1–0.15 |
| Fluorine Compound Coating Process | 0.1–0.2 |

From Table 1, when the sheets were fed by the pressure rollers 25, 25 . . . to which the nickel born plating process, the nitriding process and the hard chromium process were applied were used, the feed amount of the sheets was reduced by about 0.6 mm. Thus, a sufficient effect could not be obtained by these processes as compared with the case that the conventional pressure roller shafts 25*a*, 25*a* . . . were used. Whereas, the reduction of the feed amount of sheet could be suppressed to about 0.1–0.2 mm by the application of the fluorine containing nickel plating process, the reduction of it could be suppressed to about 0.1–0.15 mm by the application of the molybdenum compound coating process and the reduction of it could be suppressed to about 0.1–0.2 mm by the application of the fluorine compound coating process. As a result, when the fluorine containing nickel plating process, the molybdenum compound coating process and the fluorine compound coating process are applied, the reduction of the feed amount of sheet can be suppressed to about ⅓–⅙ as compared with the conventional printer sheet feed mechanism. Based on the above result, it is preferable in the embodiment to apply any of the fluorine containing nickel plating process, the molybdenum compound coating process and the fluorine compound coating process as the surface processing of the pressure roller shafts 25*a*, 25*a* . . . As a result, even if the pressure roller shafts 25*a*, 25*a* . . . are slidingly rotated by being supported by the pressure roller holders 36, 36 . . . , the surfaces of the pressure roller shafts 25*a*, 25*a* . . . can be prevented from being scratched by the glass fibers forming the pressure roller holders 36, 36 . . . and a sliding load can be reduced.

Therefore, according to the embodiment of the present invention, the lubricating property and the durability of the pressure roller shafts 25*a*, 25*a* . . . can be improved by the application of any of the fluorine containing nickel plating process, the molybdenum compound coating process or the fluorine compound coating process, whereby the sheet feed accuracy can be maintained to a high level for a long time and the recording quality can be improved.

Note, the present invention is not limited to the above embodiment and may be variously changed as necessary.

As described above, according to the printer sheet feed mechanism of the present invention, there can be achieved advantages that the sheet feed accuracy can be maintained to a high level for a long time and the recording quality can be improved by the improvement of the lubricating property and the durability of the surfaces of the pressure roller shafts.

What is claimed is:

1. A printer sheet feed mechanism, comprising at least:

a sheet feed roller disposed so as to be rotated by the drive of a drive motor; and pressure rollers disposed so as to be in contact with said sheet feed roller under pressure, wherein said sheet feed roller is composed of a metal shaft having a circular cross section, a plurality of projections are formed around the surface of the metal shaft in parallel with the axial direction of the metal shaft, each of the projections is formed in an approximately quarter-spherical semi-dome shape having a plane approximately vertical to the surface of the metal shaft with the height of the projection set to 30 to 90 $\mu$m, the projections are distributed at the pitches of 0.2 to 0.6 mm in a circumferential direction and at the pitches of 0.6 to 1.8 mm in the axial direction, and said pressure rollers have Shore hardness A in the range from 70 degrees to 97 degrees.

2. A printer sheet feed mechanism according to claim 1, wherein said pressure rollers pressed against said sheet feed roller have a pressure contact force in the range from 40 gf to 150 gf per one piece of the projections.

3. A printer sheet feed mechanism, comprising at least:

a sheet feed roller disposed so as to be rotated by the drive of a drive motor; and pressure rollers disposed so as to be in contact with said sheet feed roller under pressure, wherein said sheet feed roller is composed of a metal shaft having a circular cross section, a plurality of projections are formed around the surface of the metal shaft in parallel with the axial direction of the metal shaft, each of the projections is formed in an approximately quarter-spherical semi-dome shape having a plane approximately vertical to the surface of the metal shaft with the height of the projection set to 30 to 90 $\mu$m, the projections are distributed at the pitches of 0.2 to 0.6 mm in a circumferential direction and at the pitches of 0.6 to 1.8 mm in the axial direction, and said pressure rollers pressed against said sheet feed roller have a pressure contact force in the range from 40 gf to 150 gf per one piece of the projections.

* * * * *